US005898358A

United States Patent [19]

Tompkins et al.

[11] Patent Number: 5,898,358

[45] Date of Patent: Apr. 27, 1999

[54] VERMICULITE-COATED FUSE

[75] Inventors: Thomas L. Tompkins, Woodbury; Margaret M. Vogel-Martin, Forest Lake, both of Minn.

[73] Assignee: Minnesota Mining & Manufacturing, St. Paul, Minn.

[21] Appl. No.: 08/901,037

[22] Filed: Jul. 25, 1997

[51] Int. Cl.[6] ..... H01H 85/04

[52] U.S. Cl. ..... 337/163; 337/166; 337/295; 337/297; 337/227

[58] Field of Search ..... 337/401, 142, 337/161, 162, 163, 164, 165, 166, 158, 295, 297; D13/161

[56] References Cited

U.S. PATENT DOCUMENTS

| | | | |
|---|---|---|---|
| Re. 35,143 | 1/1996 | Funkenbusch et al. | 501/95 |
| 3,795,524 | 3/1974 | Sowman | 106/65 |
| 3,884,659 | 5/1975 | Ray | 55/379 |
| 4,047,965 | 9/1977 | Karst et al. | 106/65 |
| 4,092,194 | 5/1978 | Green | 156/89 |
| 4,166,147 | 8/1979 | Lange et al. | 428/328 |
| 4,409,729 | 10/1983 | Shah | 29/263 |
| 4,430,851 | 2/1984 | Sundet | 57/211 |
| 4,445,106 | 4/1984 | Shah | 337/163 |
| 4,757,296 | 7/1988 | Brown et al. | 337/276 |
| 4,814,585 | 3/1989 | Klein | 219/545 |
| 4,954,462 | 9/1990 | Wood et al. | 501/95 |
| 4,972,169 | 11/1990 | Kalra | 337/163 |
| 5,075,514 | 12/1991 | Hurd | 174/117 F |
| 5,102,464 | 4/1992 | Ou | 106/415 |
| 5,142,262 | 8/1992 | Onken | 337/163 |
| 5,348,918 | 9/1994 | Budd et al. | 501/95 |
| 5,476,684 | 12/1995 | Smith | 427/228 |
| 5,705,444 | 1/1998 | Tompkins et al. | 442/76 |

FOREIGN PATENT DOCUMENTS

| | | |
|---|---|---|
| 0 095 308 A1 | 11/1983 | European Pat. Off. . |
| 0 146 497 A2 | 6/1985 | European Pat. Off. . |
| WO 97/01260 | 1/1997 | WIPO . |

*Primary Examiner*—Kathryn Gorgos
*Assistant Examiner*—Wesley A. Nicolas
*Attorney, Agent, or Firm*—Gregory D. Allen

[57] ABSTRACT

Fuse comprising ceramic oxide fibers and vermiculite particulate.

13 Claims, 2 Drawing Sheets

VERMICULITE-COATED FUSE

FIELD OF THE INVENTION

The present invention relates to ceramic oxide fibers and products produced therefrom, such as electrical products.

DESCRIPTION OF RELATED ART

Crystalline ceramic oxide fiber, typically in the form of tows or yarns, can be used in products, such as in spiral wound fuse bodies and other electrical products. For such applications, the organic sizing, which is typically used in the manufacture of ceramic oxide fiber tows to protect against abrasion and resultant damage, is removed to avoid leaving a conductive residue when the fiber is exposed to high temperatures. The removal of the organic sizing, which can be done via heat treatment or other methods, including dissolution by solvent, adds extra processing steps and cost (e.g., energy costs).

It is known that particulate material, such as boron nitride, can be coated on crystalline ceramic oxide fibers to make composite articles with enhanced heat resistance and mechanical properties (see, e.g., U.S. Pat. No. 5,476,684 (Smith). Such coated fibers also include the use of an organic resin, however, and may or may not include organic sizing. Furthermore, such coated fibers are not disclosed as being useful in electrical products.

Vermiculite coated woven (5-harness satin weave) fabric made from a 50:50 by volume blend of 11 micrometer diameter aluminoborosilicate fiber (available from the 3M Company under the trade designation "NEXTEL 312") and magnesium aluminosilicate glass fiber (available under the trade designation "S2 GLASS" from Owens-Corning Fiberglas Corp.), both of which were coated with organic sizing, has been prepared by Applicants' Assignee. The intended use of the vermiculite-coated fabric was as a gas tight fire barrier. The fabric was coated on one side, or both sides, with vermiculite to seal the surface of the fabric. Thus, the vermiculite did not significantly penetrate the fabric or the fiber yarns used to prepare the fabric during the coating process. Vermiculite coated fabric made of ceramic oxide fibers is also disclosed in Applicants' Assignee's copending U.S. patent application Ser. No. 08/670,462, filed Jun. 26, 1996, now U.S. Pat. No. 5,705,440. Such fabric is useful in the preparation of filter material. It is made, for example, using fibers having organic sizing thereon. After the fabric is made, the organic sizing is optionally removed and vermiculite is applied to the surfaces of the fabric, preferably by working the vermiculite into the fabric and uniformly distributing it. Furthermore, such coated fibers are not disclosed as being useful in electrical products.

SUMMARY OF THE INVENTION

The present invention provides a method of making a ceramic oxide fiber coated with vermiculite, as well as a method of making a fiber tow of the coated fibers. The former method includes the steps of: providing a ceramic oxide fiber; and applying vermiculite particulate to the fiber in a manner such that the fiber is substantially uniformly coated with vermiculite. The method of making a ceramic oxide fiber tow includes the steps of: providing a plurality of ceramic oxide fibers; applying vermiculite particulate to the plurality of fibers in a manner such that each fiber is substantially uniformly coated with vermiculite particulate; and combining the plurality of fibers into a fiber tow. The step of combining the plurality of fibers into a fiber tow can be carried out prior to the step of applying the vermiculite particulate. Although the vermiculite can be applied using a variety of methods, it is preferably applied out of a dispersion of vermiculite particulate in a liquid carrier medium (also referred to herein as "liquid carrier", which is typically water).

Significantly, the methods of the present invention provide vermiculite-coated ceramic oxide fiber that is sufficiently free of organic material (e.g., organic processing aids) such that it is electrically nonconductive (i.e., having an electrical resistivity of greater than one mega-ohm) at the charring temperature of the organic material. By this it is meant that the fibers, tows, yarns, and articles produced therefrom, are electrically nonconductive at a temperature at which the organic material (if there is any) decomposes to form a carbonaceous residue. This temperature is referred to herein as a "charring temperature." The skilled artisan will recognize that the charring temperature is dependent on the specific organic material used, and, as such, can encompass a broad temperature range. For example, the processing aids typically used in preparing the vermiculite-coated ceramic oxide fibers char within a temperature range of about 200° C. to about 550° C. The present invention also provides a tow comprising a plurality of such fibers, and yarn comprising a plurality of such tows.

In another aspect, the present invention provides a fuse body comprising a spiral wound core comprising electrically nonconductive (having an electrical resistivity of greater than one mega-ohm) ceramic oxide fibers around which is wound a conductive fuse wire; wherein each of the ceramic oxide fibers comprises an outer surface having at least a portion thereof coated with vermiculite particulate.

In another aspect, the present invention provides an insulated wire comprising a metal wire covered with a sleeve of braided electrically nonconductive ceramic oxide fibers; wherein each of the ceramic oxide fibers comprises an outer surface having at least a portion thereof coated with vermiculite particulate. One or more insulated wires can be used to form a variety of objects, including, but not limited to, thermocouples and metal sheathed heaters.

In this application:

"ceramic" refers to crystalline ceramics, glasses, and combinations thereof,

"softening point" refers to the temperature at which a glass in the form of a 0.235 mm long fiber having a 0.55–0.75 mm diameter, at a heating rate of 5° C./min, elongates at a rate of 1 mm/min under its own weight;

"charring temperature" refers to the temperature at which organic material (e.g., processing aids) present on fibers decomposes to form a carbonaceous residue;

"fiber or continuous fiber" refers to a fiber which as infinite length compared to its diameter (i.e., having a length of at least 100 times its diameter; also see, e.g., U.S. Pat. No. 4,047,965 (Karst et al.), the disclosure of which is incorporated herein by reference);

"denier" refers to the weight in grams of 9000 meters of fiber;

"fiber tow" or "roving" refers to an assembly of a plurality of strands of ceramic fibers without twist; and "yarn" refers to two or more tows twisted together.

DESCRIPTION OF PREFERRED EMBODIMENTS

Figure 1:
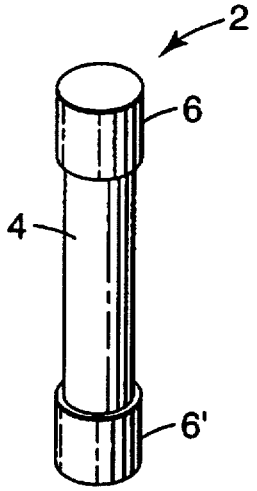
FIG. 1 is a perspective view of a slow blowing fuse according to the present invention.
Figure 3:
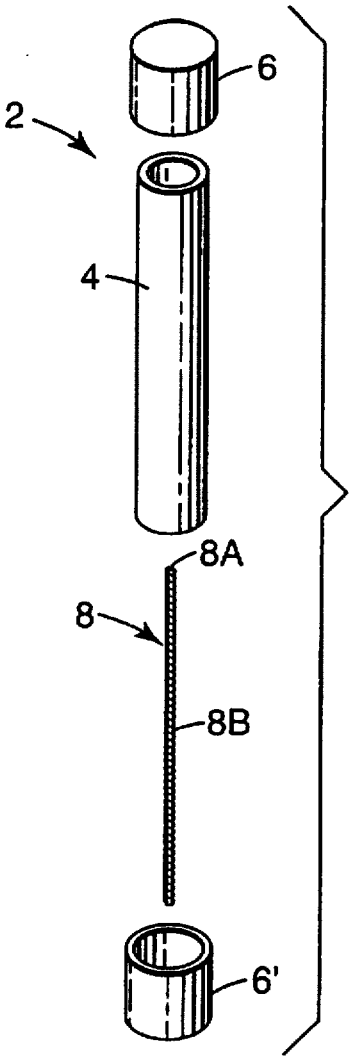
FIG. 3 is an exploded view of the parts forming the fuse shown in FIGS. 1 and 2.
Figure 2:
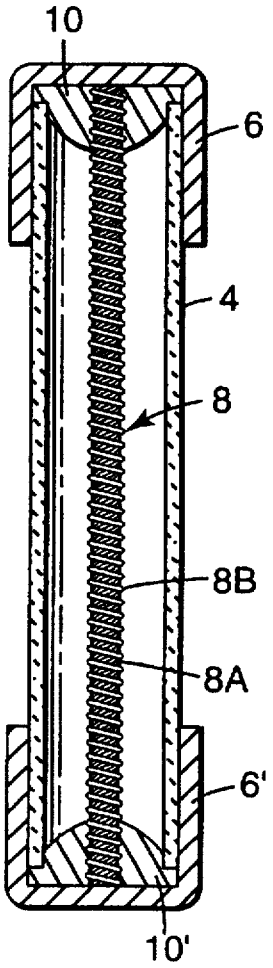
FIG. 2 is an enlarged longitudinal sectional view through the fuse shown in FIG.1.
Figure 4:
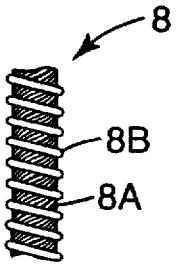
FIG. 4 is an enlarged view of a portion of the fuse body shown in FIG. 3.

Fibers used to make the products disclosed herein are typically available in continuous tows (i.e., one or more rovings, which are a plurality of continuous, parallel fibers without twist) or yarns. The fibers are ceramic metal (including Si) oxide fibers, which can be crystalline ceramic fibers, glass fibers, glass-ceramic fibers, or combinations thereof Useful continuous ceramic metal oxide fibers include, for example, aluminosilicate fibers, aluminoborosilicate fibers, alpha alumina fibers, titania fibers, yttria-alumina fibers, and zirconia fibers. Such fibers can be used in various combinations.

Preferred aluminosilicate fibers, which are typically crystalline, comprise by weight, on a theoretical oxide basis, $Al_2O_3$ in a range of about 67 percent to about 85 percent, and $SiO_2$ in a range of about 33 percent to about 15 percent. Sized aluminosilicate fibers are available, for example, under the trade designations "NEXTEL 550" and "NEXTEL 720" from the 3M Company of St. Paul, Minn.

Aluminoborosilicate fibers preferably comprise by weight, on a theoretical oxide basis, $Al_2O_3$ in a range of about 55 percent to about 75 percent, $SiO_2$ in a range of less than about 45 percent to greater than zero percent (preferably, less than about 44 percent to greater than zero percent), and $B_2O_3$ in a range of less than about 25 percent to greater than zero percent (preferably, about 1 percent to about 15 percent). The aluminoborosilicate fibers preferably are at least about 50 percent by weight crystalline, more preferably, at least about 75 percent, and most preferably, about 100 percent by weight crystalline. Sized aluminoborosilicate fibers are available, for example, under the trade designations "NEXTEL 312" and "NEXTEL 440" from the 3M Company. Preferred alumina fibers are alpha-alumina fibers available, for example, under the trade designation "NEXTEL 610" from the 3M Company.

Further, suitable aluminosilicate fibers, aluminoborosilicate fibers, and alumina fibers, can be made by techniques known in the art including those disclosed in U.S. Pat. Nos. 3,795,524 (Sowman), 4,047,965 (Karst et al.), and 4,954,462 (Wood et al.), the disclosures of which are incorporated herein by reference. Useful zirconia fibers, yttria-alumina fibers, and titania fibers can be made as described, for example, in U.S. Pat. Nos. Re. 35,143 (Funkenbusch, et al), 5,348,918 (Budd et al.), and 4,166,147 (Lange, et al), respectively, the disclosures of which are incorporated herein by reference.

Useful glass fibers typically have a softening point in a range of about 600° C. to about 875° C. Preferred glass fibers include magnesium aluminosilicate glass fibers such as those available under the trade designation "S2-GLASS" (softening point of about 860° C.) from Owens-Corning Fiberglas Corp. of Granville, Ohio. Such preferred glass fibers comprise by weight, on a theoretical oxide basis, $SiO_2$ in the range of about 64 percent to about 66 percent, $Al_2O_3$ in a range of about 24 percent to about 26 percent, MgO in a range of about 9 percent to about 11 percent, and other oxides such as CaO, $Na_2O$, $K_2O$, and $Fe_2O_3$. Another preferred glass fiber is a silicate fiber available, for example, under the trade designation "E GLASS" (softening point of about 846° C.) from Owens-Corning Fiberglas Corp. This latter fiber comprises by weight, on a theoretical oxide basis, $SiO_2$ in a range of about 52 percent to about 56 percent, $Al_2O_3$ in a range of about 12 percent to about 16 percent, CaO in a range of about 16 percent to about 25 percent, up to about 5 percent MgO, $B_2O_3$ in a range of about 5 percent to about 10 percent, and other additives such as $Na_2O$, $K_2O$, $TiO_2$, and $Fe_2O_3$. Further, quartz fibers are available, for example, under the trade designation "ASTROQUARTZ" from J.P. Stevens, Inc. of Slater, N.C. Also, leached glass fibers (i.e., glass fibers leached in acid to produce a porous high silica fiber) are available, for example, under the trade designation "SILTEMP" from Ametek, Wilmington, Del.

Ceramic metal oxide fibers also are available as "mineral wool" fibers, which tend to be short, fine diameter (i.e., about 2 micrometers to about 3.5 micrometers) fibers. Mineral wool fibers can be employed, particularly when combined with other, longer, fibers (e.g., the continuous alumina, aluminosilicate, or aluminoborosilicate fibers described above). Mineral wool fibers, which are typically aluminosilicate, are spun from molten material. Such fibers are available, for example, under the trade designations "FIBERFRAX" from Carborundum Co. of Niagara Falls, N.Y., and "CERWOOL" from Premier Refractories and Chemicals, Inc. of King of Prussia, Pa.

Preferably, the ceramic oxide fiber has a diameter in a range from about 3 micrometers to about 25 micrometers; more preferably, in a range of about 4 micrometers to about 15 micrometers. Fibers having diameters greater than about 25 micrometers are useful, but tows made from such fibers tend to be difficult to twist, and tend to have lower flexibility than those made with smaller diameter fibers. Fibers having a diameter less than about 3 micrometers may also be useful but tend to be avoided because of the small diameter.

Ceramic oxide fibers can be made by a variety of conventional methods. Preferred methods typically involve forming a fiber from a ceramic oxide sol gel and firing the fiber to form ceramic phases (see, e.g., U.S. Pat. Nos. 3,795,524 (Sowman), 4,047,965 (Karst et al.), 4,954,462 (Wood et al.), Re. 35,143 (Funkenbusch, et al), 5,348,918 (Budd et al.), and 4,166,147 (Lange, et al), the disclosures of which are incorporated herein by reference). Preferably, continuous, textile-quality ceramic oxide fibers are prepared by extruding a fiberizable sol gel into fibers that are subsequently heat treated to form ceramic oxide fibers. Typically, a fiber tow having about 350 fibers to about and 1500 fibers per tow is extruded. These individual fibers, or tows having a plurality of fibers therein, are passed through a furnace and heated to a temperature sufficient to form ceramic phases (e.g., 850° C.).

It is within the scope of the present invention for the products described herein to employ one of several types of fiber, including utilizing fibers of different compositions. Typically, the products comprise at least about 75 percent by volume (preferably, at least about 90 percent, more preferably, at least about 95 percent, and most preferably, 100 percent by volume) ceramic oxide fiber, based on the total fiber volume.

Typically, continuous fibers are treated with organic sizing materials during their manufacture to provide lubricity and to protect the fiber strands during handling. It is known that the organic sizing tends to reduce breakage of fibers and reduce static electricity during handling and processing steps. Under certain conditions, ceramic fibers tend to break, for example, as a result of self-abrasion as they are handled during the manufacturing process (e.g., as they pass through thread guides). Thus, standard practice involves coating the fibers with organic sizing materials, such as polyvinyl alcohol, starch/oil mixtures, or polyethylene glycol-polyethylene amine. Fibers having insufficient organic sizing are known to fray (i.e., break) during handling resulting in a fuzzy, damaged, lower strength fiber tow.

Surprisingly, it has been discovered that tows of fibers can be coated with vermiculite particulate instead of organic sizing materials to obtain the same types of benefits as obtained with organic sizing. In this process, fibers, either as individual fibers or as tows of fibers, for example, are coated with vermiculite particulate, typically a vermiculite dispersion optionally containing an organic processing aid, after the fibers are fired (i.e., converted to a ceramic phase), or in the case of glass fibers, drawn.

Because the vermiculite is an inorganic particulate material, rather than a continuous coating deposited from solution, it was not believed that vermiculite would be an effective substitute for organic sizing. However, it was surprisingly learned that vermiculite-coated ceramic oxide fiber tows process very well on fiber twisters (i.e., machines that make the tows into thread or yarn). This is significant because the twisting process is known to be very sensitive to organic sizing level. Too little organic sizing typically results in fuzzy, weak yarn, and too much organic sizing typically results in the fibers being sticky.

Thus, in one aspect, the present invention can provide ceramic oxide fiber coated with vermiculite such that a fiber tow comprising a plurality of vermiculite-coated ceramic oxide fibers is protected from abrasion during manufacture of the tow or products therefrom, such as yarns, braids, and fabrics. Specifically, in one aspect, the present invention provides a ceramic oxide fiber having an outer surface covered by a substantially uniform coating of vermiculite particulate. By "substantially uniform coating" it is meant that the fibers do not have uncoated portions that would result from coating the surface of a twisted yarn or a fabric woven from such fibers. This does not mean, however, that there are no minor imperfections in the uniformity of the coating that can result from different coating methods.

In another aspect, the present invention provides a ceramic oxide fiber having an outer surface covered by a sufficient amount of vermiculite such that a 900 Denier, ½ 2.7 Z twist yarn construction made from a plurality of such fibers preferably has a yarn strand break load of at least about 6.5 kilograms (kg), more preferably, at least about 7.0 kg, and most preferably, at least about 7.2 kg, as measured according to the "Break Load Test" described in Example 2, below. Further, the amount of vermiculite is sufficient such that a 900 Denier, ½ 2.7 Z twist yarn construction made from a plurality of such fibers preferably has a 50 mil (1.27 mm) yarn bend load of at least about 8.0 kg, more preferably, at least about 9.0 kg, and most preferably, at least about 10.0 kg, as measured according to the "50 Mil Bend Load Test Method" described in Example 2, below. Rovings of fibers (prior to being formed into a yarn) can also be tested according to the "Break Load Test" and "Bend Load Test." Preferably, a roving is coated with a sufficient amount of vermiculite such that it has a roving strand break load of at least about 3.0 kg, and a 50 mil (1.27 mm) roving bend load of at least about 4.5 kg.

Typically, if individual fibers or tows of such fibers are coated according to the methods of the present invention, sufficient vermiculite is coated on the outer surfaces of the individual fibers to provide fibers with these tensile properties. However, coating only the surface of a woven fabric of ceramic oxide fibers with vermiculite produces discontinuously coated fibers (i.e., fibers with an outer surface that is not substantially uniformly coated with vermiculite), which typically demonstrate inferior tensile properties.

In yet another embodiment, the present invention provides a ceramic oxide fiber having at least a portion of its outer surface covered by vermiculite particulate, wherein the vermiculite-coated ceramic oxide fiber is sufficiently free of organic material such that it is electrically nonconductive at the charring temperature of any organic material present. Typically, such fibers do not include any organic materials, although small amounts of organic sizing or other organic processing aids may be present as long as they are present in an amount below that which provides an electrically conductive carbonaceous residue at the temperature at which they char to form a carbonaceous material. The charring temperature depends on the type of organic material (e.g., processing aids) present, but is usually in a range of about 200° C. to about 550° C. Such organic processing aids include, for example, oxyalkylene polymers (e.g., polyethylene glycol), polyalkylene glycol ether (e.g., alkyloxy (polyethyleneoxypropyleneoxy) isopropanol), starch/oil, polyvinyl alcohol, etc.

Preferably, the vermiculite-coated ceramic oxide fiber includes at least about 0.5 percent by weight, and more preferably, at least about 1.5 percent by weight, of the vermiculite particulate, based on the total weight of the fiber plus vermiculite. In another aspect, the vermiculite-coated ceramic oxide fiber preferably includes no more than about 6.0 percent by weight, and more preferably, no more than about 4.0 percent by weight, of the vermiculite particulate, based on the total weight of the fiber plus vermiculite. It will be understood by one of skill in the art that if the fibers are coated with the vermiculite when they are in the form of a tow, as opposed to individual fibers, each of the fibers in the tow will not necessarily have the same coating weight of vermiculite. Typically, the fibers on the inside of the tow will have less vermiculite per fiber. Also, the total amount of vermiculite add on is dependent on the individual fiber diameters.

Vermiculite is a hydrated magnesium aluminosilicate, micaceous mineral found in nature as a multilayer crystal. Vermiculite typically comprises by (dry) weight, on a theoretical oxide basis, about 38 percent to about 46 percent $SiO_2$, about 16 percent to about 24 percent MgO, about 11 percent to about 16 percent $Al_2O_3$, about 8 percent to about 13 percent $Fe_2O_3$, and the remainder generally oxides of K, Ca, Ti, Mn, Cr, Na, Ba, etc. "Exfoliated" vermiculite refers to vermiculite that has been treated, chemically or with heat, to expand and separate the layers of the crystal, yielding high aspect ratio vermiculite platelets. These platelets can be ground up to produce small particulate, typically ranging in size (i.e., length and width) from about 0.3 micrometer to about 100 micrometers, with a mean size of about 20 micrometers. The thickness of the platelets typically ranges from about 10 Angstroms to about 4200 Angstroms. In another aspect, the vermiculite platelets may have a bi-modal distribution of particle sizes.

The vermiculite can be applied directly to the fibers during manufacture by dispersing vermiculite particulate in a liquid medium (typically water), and applying (e.g., coating) the dispersion onto the fibers. Aqueous vermiculite particulate dispersions are available, for example, from W.R. Grace of Cambridge, Mass., under the trade designation "MICROLITE 963." The desired concentration of the dispersion can be adjusted by removing or adding liquid media thereto. The dispersion can also include organic processing aids. If such organic materials are used in the preparation of the vermiculite-coated ceramic oxide fibers for some preferred applications, they are coated onto the fibers in an amount below that which would form an electrically conductive carbonaceous residue upon heating the coated fibers at the charring temperature of the organic material. This typically is an amount of no greater than about 1.0 percent by weight, based on the total weight of the fiber plus vermiculite coated thereon. Preferably, the amount of organic material present on the fibers is no greater than about 0.5 percent by weight, more preferably, no greater than about 0.1 percent by weight, and most preferably, no greater than about 0.02 percent by weight, based on the total weight of the fiber plus vermiculite. Translating this to a percentage based on the weight of the vermiculite coated onto the fibers (without the fiber weight being included), particularly preferred embodiments of vermiculite-coated ceramic oxide fibers of the present invention include no greater than about 20 percent by weight organic material.

The vermiculite can be applied to fiber tows, for example, when they are manufactured, at the same point in the process as organic sizing. That is, the vermiculite can be applied to the fibers as they exit the discharge end of a furnace. The fibers can be coated with the vermiculite as individual fibers or in a fiber tow. Typically, however, fiber tows are coated with vermiculite. This is preferably done by passing tows over a rotating applicator roll which applies the vermiculite, typically in the form of a dispersion with a liquid carrier, and preferably, in the form of an aqueous vermiculite dispersion, to the tows. During the application process, the tows open sufficiently such that the individual fibers throughout the tows are coated. Excess liquid, or excess vermiculite dispersion, is typically removed by passing the coated fiber tows between two overlapping flexible blades which effectively "squeegees" off the excess and forces the dispersion into the fiber tows. The vermiculite-coated ceramic oxide fiber tows are then wrapped around rotating "hot cans" (e.g., drums having a surface heated to about 130° C.) to evaporate carrier liquid from the dispersion. The coated fiber tows are wound onto cores for later use. Alternatively, the tows can be immediately fabricated into thread, yarn, or fabric, as is known in the art.

Although it is preferred to coat individual fibers or fiber tows with vermiculite, the vermiculite can be applied to the products once they are prepared using conventional techniques such as dip coating, spray coating, and brush coating. For such methods, the fibers or tows typically would be coated with organic sizing. If fibers having organic sizing thereon are used to make products according to the present invention, it is preferred that any sizing present on the fibers be removed before the vermiculite is applied. The sizing can be removed by conventional techniques including extracting with water or other solvents, heating to burnoff or decompose the size material (e.g., heating the fabric for 24 hours at a temperature in the range from about 204° C. (400° F.) to about 400° C. (750° F.)).

Vermiculite-coated ceramic oxide fiber tows, and such tows twisted to form threads and yarns, are useful, for example, in the production of thermocouples, fuses, heating elements, and in other applications where it is desirable to use ceramic fibers but where the presence of organic sizing, which produces undesirable carbonaceous residue at the charring temperature of the organic sizing, can cause electrical shorting. Thus, the coated fibers of the present invention can be used in any application that requires a ceramic fiber with an electrically nonconductive coating on it.

A particularly desirable use of the vermiculite-coated ceramic oxide fiber tows is in spiral wound fuse bodies. Examples of such products are disclosed, for example, in U.S. Pat. Nos. 4,445,106 (Shah) and 4,409,729 (Shah), the disclosures of which are incorporated herein by reference. Specifically, as shown in FIGS. 1–4, slow blowing fuse 2 includes main cylindrical casing 4 of a suitable insulating material (e.g., ceramic material), closed by conductive end caps 6 and 6'. Spiral wound fuse body 8 is in electrical contact with and extends between end caps 6 and 6' where the fuse wire portion of body 8 is intimately anchored and electrically connected to these end caps by solder 10 and 10'.

Spiral wound fuse body 8 includes core 8A of vermiculite-coated ceramic oxide fibers according to the present invention. Such vermiculite-coated ceramic oxide fibers are advantageous because they are substantially devoid of any organic sizing or other organic material that will form a carbonaceous residue conductive path under fuse blowing conditions. This does not mean, however, that there is absolutely no organic material used. If organic processing aids are used in the preparation of the vermiculite-coated ceramic oxide fibers for some preferred applications, they are used in an amount below that which would form a conductive carbonaceous path at a temperature at which the organic material chars. Fuse wire winding 8B is bound around ceramic core 8A. The fuse wire may be a tin-coated or uncoated body of fuse wire of copper or other material that gives the desired blowing qualities under the heat sinking conditions of core 8A. Differently rated fuses may be achieved, for example, by varying the diameter or composition of the basic fuse wire, the thickness and type of coating on the fuse wire, and the heat sink characteristics of the core, as is known to one of skill in the art.

Typically, in the manufacture of such fuse bodies, fiber tows are initially coated with vermiculite and twisted into yarn (e.g., 900 denier, ½ 2.7 Z ply twisted yarn). This yarn is then wound, for example, at 18 windings/centimeter (46 windings/inch) with a small copper wire, preferably, tin-coated copper wire (e.g., 0.018 centimeter diameter). This assembly is then cut to an appropriate length for mounting inside a glass tube with metal ends soldered to the ends of the copper wire to form a fuse. When the fuse is exposed to excess current (i.e., the fuse "blows"), the copper wire melts and opens the circuit. The vermiculite coated ceramic fibers maintain the high insulation resistance required. Thus, there is no leakage of current after the fuse has blown. By contrast, fuses produced in this manner with organic sizing on the yarn do not work. Temperature conditions during the blowing of the fuse results in carbonization of the sizing, leaving a conductive carbonaceous path along the core. The blown fuse will not have the required insulating resistance.

The vermiculite-coated ceramic oxide fibers according to the present invention are also useful as insulation around wires. Such insulated wires can be used with noninsulated wires or with other insulated wires in, for example, thermocouples and metal sheathed heaters. Thus, the present invention provides an insulated wire comprising a metal wire covered with a sleeve of braided ceramic oxide fibers; wherein each of the ceramic oxide fibers comprises an outer surface having at least a portion thereof coated with vermiculite particulate.

A typical thermocouple is made of two types of alloy wires welded together to form a thermocouple junction. For example, a Type K thermocouple is made of a nickel-chromium alloy ("CHROMEL") wire and a nickel-aluminum alloy ("ALUMEL") wire, each about 0.10 centimeter in diameter. One end of each of the two types of alloy wires are welded together to form a thermocouple junction; however, the wires must be insulated from each other to prevent contact, which will cause an error in the temperature reading.

A commonly used insulation in thermocouples is a ceramic material, such as fiberglass (as disclosed, for example, in U.S. Pat. No. 5,075,514 (Hurd), the disclosure of which is incorporated herein by reference), which can be difficult to braid onto the wires without the use of organic sizing material coated thereon. Vermiculite-coated ceramic oxide fibers in the form of yarns, for example, can be braided relatively easily onto thermocouple wires, thereby producing a flexible thermocouple. Braiding a sleeve of vermiculite-coated ceramic oxide fiber yarns over the alloy wires can be done using a 16 carrier braider (commercially available, for example, as a "NEB 16 carrier braider" from Wardwell Braiding Machine Co. of Central Falls, R.I.). In order to make the thermocouple easier to handle, both wires can then be over braided, for example, with a second layer of vermiculite-coated ceramic oxide fibers in the form of yarn. This can be done, for example, by feeding both the fiber-wrapped nickel-chromium wire and the fiber-wrapped nickel-aluminum wire into the braider at the same time.

Figure 5:
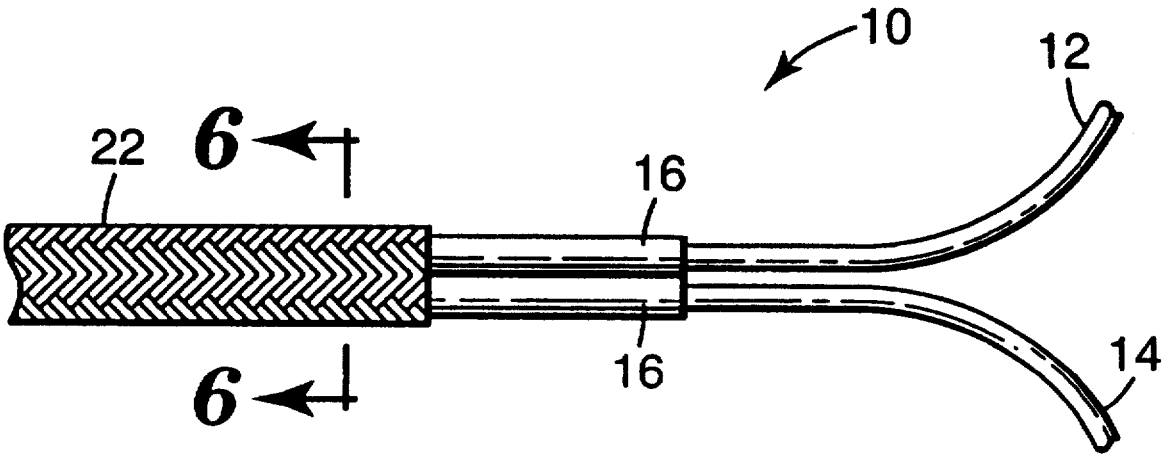
FIG. 5 is a partial, cut-away, plan view of a thermocouple according to the present invention.
Figure 6:
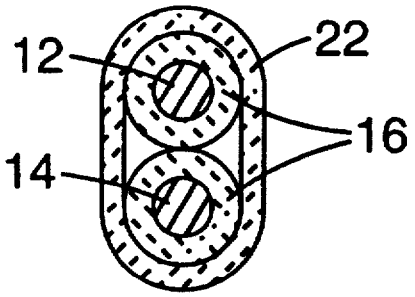
FIG. 6 is a sectional view of the thermocouple of FIG. 5, taken along line 6—6 of FIG. 5.

Referring to FIGS. 5 and 6, thermocouple 10 includes two wires 12 and 14, each having a sleeve 16 of vermiculite-coated ceramic oxide fiber yarns. It is understood, however, that thermocouples could also be formed in which only one of the wires has a braided sleeve of vermiculite-coated ceramic oxide fiber yarns. Both wires are then braided together with a second layer of vermiculite-coated ceramic oxide fiber yarn to form jacket 22.

Such vermiculite-coated ceramic oxide fiber insulation is particularly advantageous for use in a high temperature vacuum or in a reducing atmosphere, in which organic materials typically decompose to form larger amounts of conductive carbonaceous residue. The conductive residue produces a conductive path between the thermocouple wires and produces an error in the temperature indication. Thus, thermocouples containing fibers with organic sizing require heat cleaning to remove the organic sizing; however, this can change the calibration of the wire, making the thermocouple uncertifiable. This heat cleaning step is not necessary when the vermiculite-coated ceramic oxide fibers according to the present invention are used.

The vermiculite-coated ceramic oxide fibers according to the present invention could also be useful for metal sheathed heaters of the type used in kitchen ranges. These heaters are typically made by braiding vermiculite-coated ceramic oxide fiber yarns, for example, onto a resistance heater wire and then inserting this assembly into a metal sheath and sealing the end. Upon heating, any organic sizing present when conventional sized fibers are used would decompose to form carbonaceous residue between the heater wire and the metal sheath. Because the residue is sufficiently electrically conductive, it would form a short circuit. As discussed above, the use of the vermiculite-coated ceramic oxide fibers would not form a sufficiently electrically conductive path.

Vermiculite-coated ceramic oxide fibers according to the present invention can be used in a variety of other products as well. For example, the vermiculite-coated ceramic oxide fibers could be used in surface heating systems that include fabric containing a heat-producing electrical conductor, as disclosed, for example, in U.S. Pat. No. 4,814,585 (Klein), the disclosure of which is incorporated herein by reference. The vermiculite-coated ceramic oxide fibers according to the present invention could also be used in flexible thermally insulated heating devices, such as those that wrap around a feed barrel of a plastics injection molding machine or the dies of a plastics extruding machine, as disclosed, for example, in International Publication No. WO 97/01260 (Exotherm Products Limited), published Jan. 9, 1997, the disclosure of which is incorporated herein by reference. Also, twisted ceramic fiber sewing thread, such as that disclosed, for example, in U.S. Pat. No. 4,430,851 (Sundet), the disclosure of which is incorporated herein by reference, can also be coated with vermiculite. Such thread made from vermiculite-coated ceramic oxide fibers is useful at high temperatures in applications in which a carbonaceous residue would be problematic.

Objects and advantages of this invention are further illustrated by the following examples, but the particular materials and amounts thereof recited in these examples, as well as other conditions and details, should not be construed to unduly limit this invention. All parts and percentages are by weight unless otherwise indicated.

EXAMPLE 1

This example illustrates the preparation of a tow of aluminosilicate fibers coated with vermiculite. An aqueous vermiculite dispersion was prepared by adding 400 grams of vermiculite dispersion (7.5 percent solids; commercially available under the trade designation "MICROLITE 963" from W.R. Grace of Cambridge, Mass.) to 600 grams of deionized water along with 0.2 gram of a polyalkylene glycol ether surfactant (commercially available as alkyloxy (polyethylene-oxypropyleneoxy) isopropanol under the trade designation "TERGITOL 2X" from Union Carbide Corp. of Danbury, Conn.), and mixing for 2 minutes.

Aluminoborosilicate fibers were prepared as described in Example 1 of U.S. Pat. No. 3,795,524 (Sowman), the disclosure of which is incorporated herein by reference. At the discharge end of the furnace, the fiber tow, containing nominally 400 filaments (or fibers), traveling at 122 meters/minute (400 feet/minute), passed over an applicator roll turning at 60 revolutions per minute (rpm). The applicator roll applied aqueous vermiculite dispersion to the fiber tow. Excess dispersion was removed by passing the fiber tow through overlapping flexible blades, which effectively wiped off excess dispersion.

The fiber tow was then fed onto a rotating "hot can" and wrapped side by side 15 times. The surface of the can was heated to about 130° C. and rotated at a surface speed of about 122 meters/minute (400 feet/minute). This heat treatment served to remove any moisture from the fiber tow. The fiber tow was then wound onto a cardboard core to store for further use. The amount of vermiculite coated onto tows ranged from about 0.5 weight percent to 3 weight percent, based on the total weight of the fiber and vermiculite.

EXAMPLE 2 AND COMPARITIVE EXAMPLES I–III

For Example 2, fiber tow (900 Denier) prepared as described in Example 1 was sized with vermiculite by passing the tow through a sizing tray containing a 2 percent by weight dispersion of vermiculite (available under the trade designation "MICROLITE 963" from W. R. Grace of Cambridge, Mass.) in deionized water containing 0.1 percent by weight of a polyalkylene glycol ether surfactant (available as alkyloxy(polyethyleneoxypropyleneoxy) isopropanol under the trade designation "TERGITOL 2X" from Union Carbide Corp., Danbury, Conn.), and 0.1 percent by weight of an oxyalkylene polymer surfactant (available as polyethylene glycol under the trade designation "CARBOWAX 600" from Union Carbide Corp.) immediately after the fiber exited the firing furnace. The sized tow was dried as described in Example 1, wound on paper cores, and twisted into a ply twisted yarn having a 900 Denier ½ 2.7 Z twist construction. The amount of vermiculite coated onto the tows was 1.9 weight percent based on the total weight of the fiber and vermiculite.

For Comparative Example I, woven tape (5.1 cm wide) which was woven from organic sized aluminoborosilicate ceramic oxide yarn (available from the 3M Company under the trade designation "NEXTEL 312") having the same twist construction as described above (900 Denier ½ 2.7 Z twist construction), was cut into approximately 35.6 cm long samples. These samples were heat cleaned at 550° C. for 30 minutes to remove the organic sizing. The samples were removed from the furnace, cooled to room temperature, and dipped into a sizing dispersion having the same composition as described above (i.e., the 2 percent by weight dispersion of vermiculite in deionized water containing 0.1 percent by weight of polyalkylene glycol ether surfactant and 0.1 percent by weight of oxyalkylene polymer surfactant). The samples were vertically withdrawn from the sizing dispersion, excess dispersion allowed to drain from the tape for approximately 30 seconds, and then hung vertically in a dryer maintained at 110° C. for 1 hour. The amount of vermiculite coated onto the tape samples was about 1.7 weight percent based on the total weight of the fiber and vermiculite.

For Comparative Examples II and III, organic sized aluminoborosilicate ("NEXTEL 312") yarn having the same twist construction as described above (900 Denier ½ 2.7 Z twist construction) was used. The organic sized yarn was used as received for Comparative Example II. For Comparative Example III, however, the organic sized yarn was heat cleaned at 550° C. for 20 minutes to remove the organic sizing.

The sized yarns of the present invention prepared as described above (Example 2), individual warp direction yarns that were removed from the sized tape samples prepared as described above (Comparative Example I), and organic sized yarns used as received (Comparative Example II) or heat cleaned (Comparative Example III) were evaluated using a yarn (or roving) strand "Break Load Test" and a "50 Mil (1.27 mm) Bend Load Test". The yarn (or roving) strand break load was determined substantially as described in ASTM D-2256-69, published Oct. 3, 1969, the disclosure of which is incorporated herein by reference, except that a gage length of 15.24 cm (6 inches) and a constant cross-head speed of 1.27 cm/minute (0.5 inches/minute) were used. The "50 Mil Bend Load Test" is based on the "Break Load Test" except that the lower jaw of the test instrument is replaced by a 50 mil (1.27 mm) diameter rod and the yarn sample is looped around the rod with both ends of the sample clamped in the upper jaw of the instrument. This configuration effectively results in a 7.62 cm (3 in) gage length for the sample. Results for both tests are reported as an average of 10 samples, and are reported in Table 1, below.

TABLE 1

| Example | Mean ± Std. Dev. | High | Low |
|---|---|---|---|
| | Yarn Strand Break Load | | |
| 2 | 7.46 ± 0.22 kg | 7.88 kg | 7.06 kg |
| Comp. I | 5.79 ± 0.25 kg | 6.34 kg | 5.5 kg |
| Comp. II | 8.66 ± .045 kg | 9.12 kg | 7.62 kg |
| Comp. III | 3.18 ± 0.41 kg | 3.63 kg | 2.40 kg |
| | 50 Mil Yarn Bend Load | | |
| 2 | 10.48 ± 0.47 kg | 11.45 kg | 9.93 kg |
| Comp. I | 7.11 ± 0.82 kg | 8.30 kg | 5.72 kg |
| Comp. II | 5.94 ± 0.77 kg | 7.12 kg | 4.67 kg |
| Comp. III | 3.08 ± 0.59 kg | 4.08 kg | 2.45 kg |

| Example | Roving Strand Break Load Load* | 50 Mil Roving Bend Load Load* |
|---|---|---|
| 2 | 3.20 ± 0.13 kg | 4.91 kg ± 0.25 kg |

*These are an average of six tests.

The "Break Load Test" and "50 Mil Bend Load Test" demonstrate that sizing the tow prior to twisting into a yarn and weaving into fabric produces a more uniform coating on the individual fibers, as is evidenced by higher break load and 50 mil bend load values, than applying the same sizing to a woven fabric prepared from yarns of the same construction.

EXAMPLE 3 AND COMPARATIVE EXAMPLE IV

For Example 3, the electrical conductivity of fibers made according to the procedure of Example 2 was evaluated. For Comparative Example IV, the electrical conductivity of organic sized aluminoborosilicate ("NEXTEL 312") yarn having a 900 Denier ½ 2.7 Z twist construction was evaluated.

A base reference of minimum resistance between two legs of a thermocouple wire before a temperature readout error occurred was established as follows: a standard Type K thermocouple (available from Omega International Corp. of Stamford, Conn.) was connected in parallel to a temperature readout device (Model 3087 Portable Hybrid Recorder, available from Yokogawa Electric Corp. of Tokyo, Japan) and a 10K variable resistor (Cat. No. 271-1721, available from Tandy Corp. of Fort Worth, Tex.). The welded end of the thermocouple was inserted into an electric furnace maintained at 809.6° C. and allowed to equilibrate with the furnace. After equilibration the resistance was varied and the temperature readout associated with the resistance recorded, as reported in Table 2, below.

TABLE 2

| Effective Resistance (Ω) on Thermocouple Readout Error | Temperature (° C.) |
|---|---|
| ∞ | 809.6 |
| 5,000 | 809.1 |
| 4,000 | 808.9 |
| 3,000 | 808.6 |
| 2,000 | 808.3 |
| 1,000 | 807.3 |
| 500 | 804.5 |

Samples of the vermiculite-coated fibers of Example 3 and the fibers of Comparative Example IV were woven around standard thermocouple wires (Chromel and Alumel, available from Hoskins Manufacturing Co. of Detroit, Mich.) and a pair of these wires braided together. One end of the braided pair was cut with a wire cutter and inserted into a quartz protection tube while the opposite end of the braided pair was connected to an ohm meter. The quartz tube was inserted into an electric furnace maintained at 800° C. and the resistance of the thermocouple recorded as a function of time, the results of which are reported in Table 3, below.

TABLE 3

| | Resistance (in Ohms) of Thermocouple Constructions | |
|---|---|---|
| Time, minutes | Example 3 | Comparative Example IV |
| 0.5 | 20,000,000 | 120,000 |
| 1 | 10,000,000 | 20,000 |
| 1.5 | 5,000,000 | 5,000 |
| 2 | 4,000,000 | 300 |
| 3 | 3,000,000 | 60 |
| 10 | 2,500,000 | 9.5 |

On completion of the test the thermocouple construction utilizing the vermiculite sized yarn remained substantially unchanged in appearance with a high insulation resistance between the two wires. The thermocouple construction utilizing the organic sized yarns showed significant evidence of a carbon char which provided a conductive path through the insulation between the two wires that produced essentially a short circuit (9.5 Ohms resistance).

Although organic sized yarns have break load and 50 mil bend load values comparable to those obtained with the vermiculite, organic sized yarns demonstrate markedly lower electrical resistance on exposure to high temperatures, which corresponds to higher electrical conductivity and electrical failure of the insulation.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A fuse body comprising a spiral wound core comprising electrically nonconductive ceramic oxide fibers around which is wound a conductive fuse wire; wherein each of the ceramic oxide fibers comprises an outer surface having at least a portion thereof coated with vermiculite particulate.

2. The fuse body according to claim 1 wherein the fiber has on said surface about 0.5 percent to about 6.0 percent by weight of the vermiculite particulate, based on the total weight of the fiber plus vermiculite.

3. The fuse body according to claim 1 wherein the vermiculite particulate have lengths and widths each in a range of about 0.3 micrometer to about 100 micrometers, and thicknesses in a range of about 10 Angstroms to about 4200 Angstroms.

4. The fuse body according to claim 1 wherein the ceramic oxide fibers are selected from the group of alpha alumina fibers, aluminosilicate fibers, aluminoborosilicate fibers, zirconia fibers, yttria-alumina fibers, titania fibers, and combinations thereof.

5. The fuse body according to claim 4 wherein the ceramic oxide fibers are aluminoborosilicate fibers.

6. The fuse body according to claim 1 wherein the ceramic oxide fibers are crystalline ceramic oxide fibers.

7. The fuse body according to claim 1 wherein the ceramic oxide fibers are glass fibers.

8. The fuse body according to claim 7 wherein the glass fibers comprise by weight, on a theoretical oxide basis, $SiO_2$ in a range of about 64 percent to about 66 percent, $Al_2O_3$ in a range of about 24 percent to about 26 percent, MgO in a range of about 9 percent to about 11 percent, based on the total oxide content of the respective fibers.

9. The fuse body according to claim 8 wherein glass fibers are made of glass having a softening point in a range of about 600° C. to about 875° C.

10. The fuse body according to claim 1 wherein the ceramic oxide fibers comprise crystalline ceramic oxide fibers, glass fibers, glass-ceramic fibers, or combinations thereof.

11. The fuse body according to claim 1 wherein the outer surface of each of the ceramic oxide fibers further comprises an organic processing aid.

12. The fuse body according to claim 11 wherein the organic processing aid is present in an amount below that which provides an electrically conductive carbonaceous residue at the charring temperature of the organic processing aid.

13. The fuse body according to claim 12 wherein the organic processing aid is present in an amount of no greater than about 1.0 percent by weight, based on the weight of the vermiculite coating plus fiber.

* * * * *

UNITED STATES PATENT AND TRADEMARK OFFICE

CERTIFICATE OF CORRECTION

PATENT NO. : 5,898,358
DATED : April 27, 1999
INVENTOR(S) : Tompkins et al.

It is certified that error appears in the above-identified patent and that said Letters Patent is hereby corrected as shown below:

Col. 4, Line 49, between "about 350 fibers to about" and "1500 fibers", delete "and"

Signed and Sealed this

Fifth Day of June, 2001

*Attest:*

*Attesting Officer*

Nicholas P. Godici

NICHOLAS P. GODICI

*Acting Director of the United States Patent and Trademark Office*